US005425253A

United States Patent [19]

Rizzo

[11] Patent Number: 5,425,253

[45] Date of Patent: Jun. 20, 1995

[54] MEASURING DISPENSER FOR WASHING POWDERS TO BE PLACED INSIDE WASHING MACHINES

[75] Inventor: Francesco Rizzo, Gavirate, Italy

[73] Assignee: Mira Lanza S.p.A., Milan, Italy

[21] Appl. No.: 223,682

[22] Filed: Apr. 6, 1994

[30] Foreign Application Priority Data

Apr. 7, 1993 [IT] Italy ..... GE93U0013

[51] Int. Cl.[6] ..... D06F 39/02

[52] U.S. Cl. ..... 68/17 R; 206/0.5

[58] Field of Search ..... 68/17 R, 235 R; 206/0.5; 422/265, 266; 252/90, 92, 95

[56] References Cited

U.S. PATENT DOCUMENTS 3,400,808 9/1968 Richter .
4,835,804 6/1989 Arnau-Munoz et al. ..... 206/0.5 X
5,211,689 5/1993 Kobayashi .
5,355,541 10/1994 Rutter et al. ..... 68/17 R X

FOREIGN PATENT DOCUMENTS 0253419 1/1988 European Pat. Off. .
0345409 12/1989 European Pat. Off. .
WO91/0433-68 4/1991 European Pat. Off. .
9103668.2 8/1991 Germany .
2244722 12/1991 United Kingdom .

*Primary Examiner*—Philip R. Coe
*Attorney, Agent, or Firm*—Larson and Taylor

[57] ABSTRACT

Measuring dispenser that includes a container of an essentially flattened elliptical cylindrical shape provided with a port through which the washing powder is admitted, a series of narrow slits through which the dissolved powder is dispensed, and a recess which houses the handle of a measuring spoon. The measuring spoon is connectable to the container by inserting its handle into the recess and the cup part into its loading port.

2 Claims, 2 Drawing Sheets

MEASURING DISPENSER FOR WASHING POWDERS TO BE PLACED INSIDE WASHING MACHINES

BACKGROUND Of THE INVENTION

The present invention relates to measuring dispensers for washing powders to be placed in the drum of a washing machine, with the laundry to be washed.

Many devices of this kind are known.

So, for instance, from EP-A-0345 409 a device is known comprising a closable bag-like element made from an open-pore cellular structure, containing the measuring dispenser.

From WO-A-91 04368 a dispenser reservoir for receiving and discharging washing agents is known, comprising a filling antechamber which is arranged in front of a washing agent receiving space. The said antechamber communicates with the washing agent receiving space through openings whose cross section may be varied, and is designed as an unloading measuring bucket for the dispenser reservoir.

From DE-U-91 03 668 a measuring dispenser is known comprising a cup-like element to which a cover provided with one or more openings is hingedly connected.

From EP-A 0253 419 a device is known comprising a body having at least one movable part enabling it to occupy an open position in which the device serves as a means of extracting a measured amount of washing powder and a closed position in which the device acts as distribution means.

From U.S. Pat. No. 3,400,808 a dispenser is known comprising two separate cup-shaped body members detachably connected at their open ends, one of said members being a measuring cup having imperforate walls, and the other member having perforate walls through which said material may dispense.

From GB-A-2 244 722 a dispensing device is known comprising a body for holding the washing powder and a lid for the body. The lid comprises a mesh like arrangement of perforations.

However all the said prior art devices have certain drawbacks. In the first place, many of these devices are cumbersome and have shapes which do not fit easily into the packs of washing powder, and particularly into the modern packs of concentrated washing powder, which are of very reduced sizes also in order to reduce the amount and volume of wastes.

Furthermore, such devices often have sharp angles that can abrade or cut the articles being washed.

Moreover, many of said devices are complicated and costly.

SUMMARY OF THE INVENTION

It is therefore the main object of the present invention to overcome to the drawback of the known prior art devices by providing a measuring dispenser of flattened and compact shape that fits easily into a pack of washing powder and has no external sharp edges.

This object is achieved by means of a measuring and dispensing device comprising a container of an essentially flattened elliptical cylindrical shape provided with a port through which the washing powder may be loaded, a series of narrow slits through which the dissolved powder is dispensed, and a recess which is apt to house the handle of a measuring spoon, said measuring spoon being connectable to said container by inserting its handle into said recess and its cup part into the loading port, thus acting also as a closure member for the washing powder loading port during the washing process.

Furthermore, said measuring dispenser has neither edges nor asperities on its surface that could crease the load of articles being washed.

BRIEF DESCRIPTION OF THE DRAWING FIGURES

Further advantages and features will be made apparent from the following description of a preferred embodiment of the measuring dispenser according to the present invention, made with reference to the accompanying drawings, in which:

FIG. 1 is a top plan view of the measuring dispenser according to the invention, FIG. 2 is a side elevation view of the measuring dispenser of FIG. 1, and FIG. 3 is longitudinal section of the measuring dispenser according to the invention taken along the line III—III of FIG. 1.

DESCRIPTION OF THE PREFERRED EMBODIMENT

Figure 1:
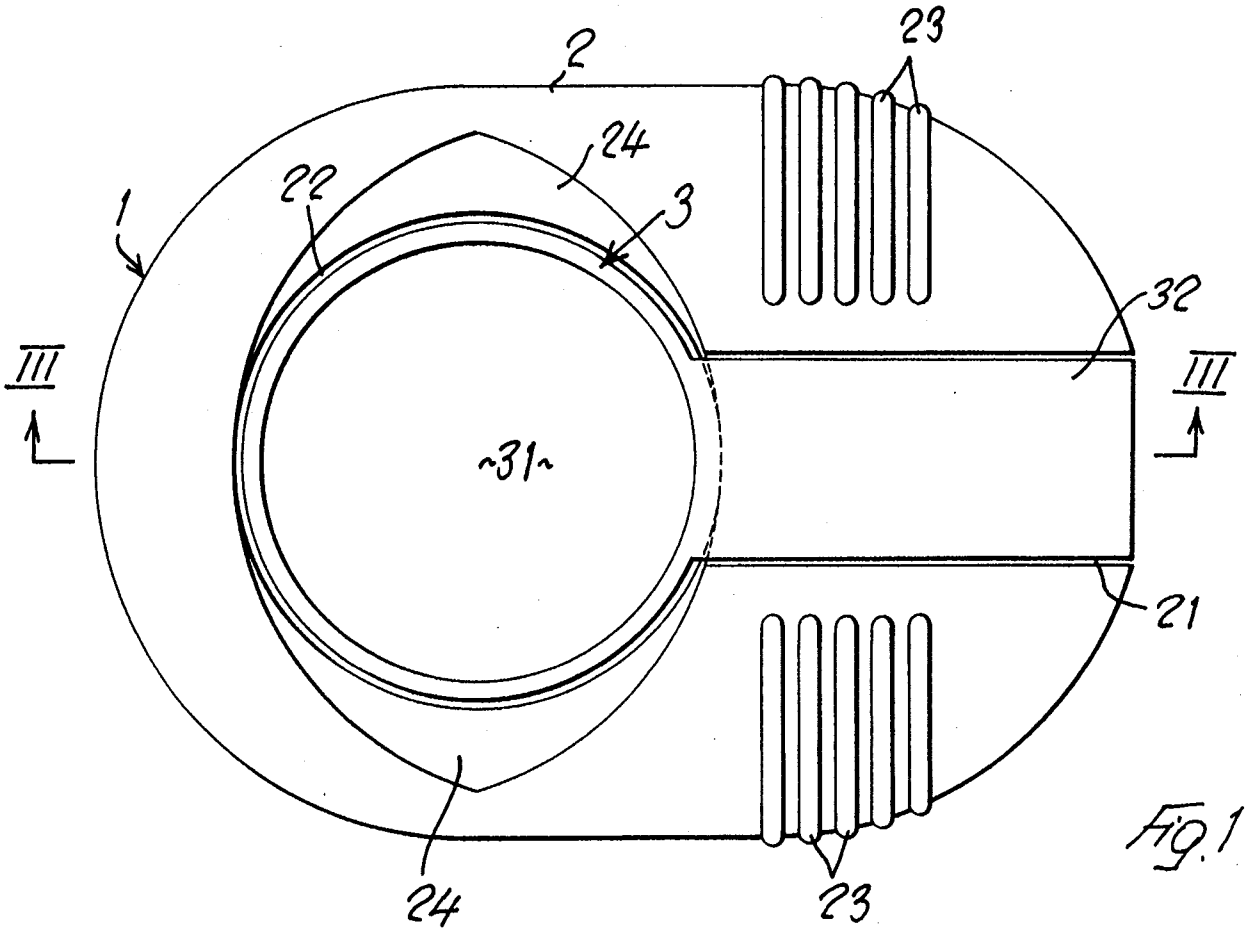
Figure 2:
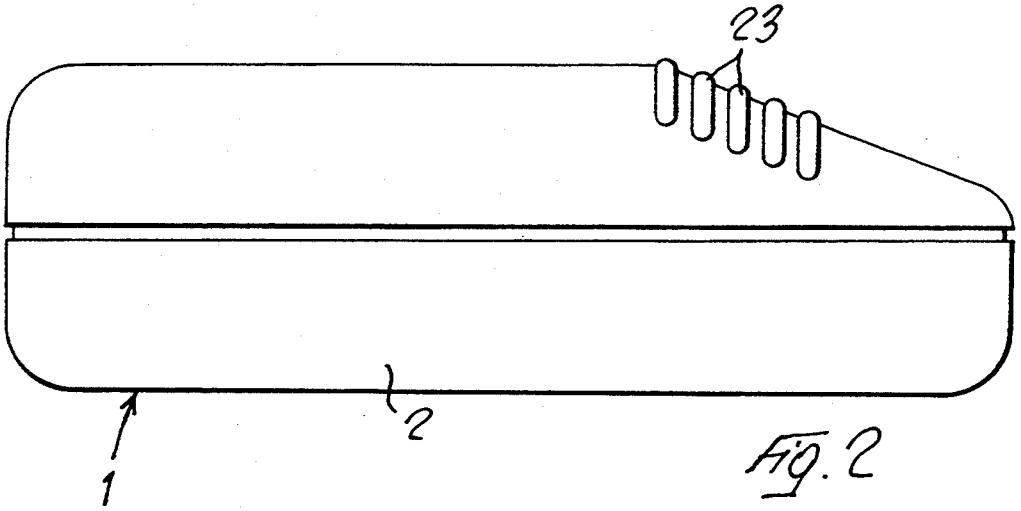
Figure 3:
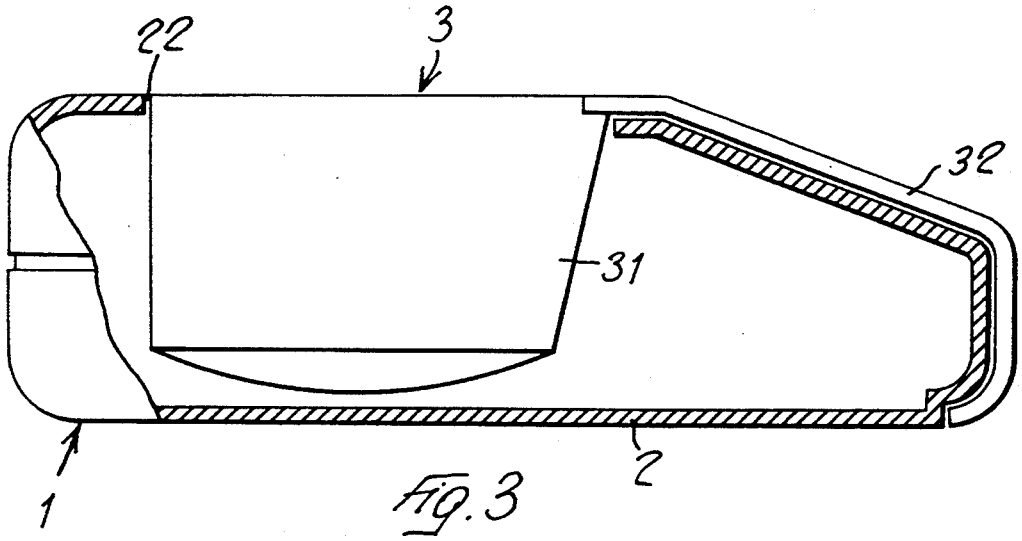

With reference to the drawings, and with particular reference to FIG. 1, the numeral 1 denotes a measuring dispenser according to the invention. The dispenser shown comprises a container 2 and a measuring spoon 3. The container 2 is essentially of elliptical cylindrical shape with a downwardly outwardly inclined upper flat face at one end, the inclination inclination angle of said face being approximately parallel to the diagonal of the longitudinal section of said elliptical cylindrical container. The container 2 is provided at its upper, non inclined face with a funnel-shaped depression 24 which surrounds the washing powder loading port 22, into which port 22 the cup portion 31 of the measuring spoon 3 is inserted. Between said port 22 and the far end of the inclined face of the dispenser 1 face, an approximately rectangular recess 21 is formed in which the handle 32 of said measuring spoon 3 is housed, the recess 21 continuing over the lateral surface of said container 2. On the said upper inclined face of the dispenser 1, at the sides of this recess 21, two series of narrow slits 28 are formed, acting as diffusion opening for the washing powder which is dissolved during the washing process.

The above described measuring dispenser is loaded by taking the measuring spoon 8 out of its housing and filling the container 2 through the loading port 22 with wash powder collected in the dosing cup 81 of the measuring spoon $. The filling operation is further facilitated by the presence of the funnel shaped depression 24 surrounding the port 22. The loading port of the measuring dispenser is thereafter again closed by means of the spoon 8 and the dispenser can be placed in the drum of a washing machine above, below or inside of a load of laundry to be washed, and the operation of the machine may be started. The powder contained in the dispenser will be dissolved and diffused at the beginning of the washing cycle through the narrow slits 28.

Owing to the fact that the measuring dispenser according to the invention is of essentially flattened shape, it will also be easy to insert it into different kinds of packages, and for example in a recess formed in the lids of the boxes of washing powder. Moreover, the absence of sharp angles on its surface means that the load of laudry will not be damaged.

I claim:

1. A measuring dispenser for a washing powder to be placed inside of a drum of a washing machine in contact with laundry to be washed in the washing machine, comprising:

a container of an essentially flattened elliptical cylindrical shape provided with (a) a loading port through which the washing powder is admitted, (b) a funnel-shaped depression surrounding said loading port, (c) a series of narrow slits in said container through which the washing powder becomes dissolved during a washing cycle of the washing machine and dispensed in a washing bath, and (d) a recess; and a measuring spoon having a handle which is housed in said recess, said measuring spoon acting as a closure member for said loading port and being connectable in an easily disconnectable manner to said container by inserting said handle into said recess and said cup portion into the loading port.

2. A measuring dispenser according to claim 1, in which said measuring dispenser includes edges which are all rounded, and in which said container has a downwardly outwardly inclined upper flat face at a longitudinal end thereof.

* * * * *